US005688165A

United States Patent [19]

Levasseur

[11] Patent Number: 5,688,165

[45] Date of Patent: Nov. 18, 1997

[54] MEANS FOR PRODUCING ENHANCED COIN PAYOUT CAPACITY IN VENDING MACHINE

[75] Inventor: Joseph L. Levasseur, St. Louis County, Mo.

[73] Assignee: Coin Acceptors, Inc., St. Louis, Mo.

[21] Appl. No.: 610,114

[22] Filed: Feb. 29, 1996

[51] Int. Cl.[6] ..... G07D 3/04

[52] U.S. Cl. ..... 453/9; 453/17

[58] Field of Search ..... 453/9, 17; 194/217, 194/218

[56] References Cited

U.S. PATENT DOCUMENTS 3,187,760 6/1965 Simjian ..... 453/17

3,971,393 7/1976 Akai et al. ..... 453/17

*Primary Examiner*—F. J. Bartuska

*Attorney, Agent, or Firm*—Haverstock, Garrett and Roberts

[57] ABSTRACT

A mechanism for mounting on a vending control device used for paying back change to a customer for a deposit in excess of the amount of a selected vend including a coin storage device located at a higher elevation than the payback coin tube, the coin storage device when energized releasing one or more coins from the bottom end thereof when it is determined that the number of coins available in the payback coin tube is less than the amount needed for a payback, and a passageway communicating the lower end of the coin storage device with the upper end of the payback coin tube for guiding coins released from the coin storage device to move into the payback coin tube.

10 Claims, 3 Drawing Sheets

MEANS FOR PRODUCING ENHANCED COIN PAYOUT CAPACITY IN VENDING MACHINE

The present invention relates to an improvement in the change making capacity of vending machines including making use of the existing coin changer mechanisms and controls and without requiring any additional electrical or software changes.

It is important, if not critical to the successful operation of a vending machine that certain coins be available for change payback, and this becomes especially important as the size and/or capacity of the vending machine increases. In the past, this has been solved, at least in part by having an out-of-change control or indicator which tells the customer if he wants to get the desired vend at the vend price to use the exact change required to make the purchase. There is also a trend in vending devices to provide means to accept dollar bills for vends and this can result in even more frustration if the vending machine is not able to make the necessary change.

Most coin changers have limited space for storing coins used for making change. Furthermore, the need for having adequate amounts of change to accommodate different deposits and vending functions will vary depending upon the vend or sale price, and the more prevalent denomination of coins that are used for making change. It is therefore desirable to provide means such as retro-fitting means that are attachable and usable on existing vending machine, and particularly that use certain denominations of coins that are most frequently used in the change making procedure to increase the change making capacity. The present improvement satisfies this need with minimum modification to the existing coin changer. The present invention involves providing one or more additional coin tubes, each with motor or solenoid for dispensing coins therefrom, and to be able to mount the additional coin tube or tubes at a location sufficiently above the existing coin change payout tubes to provide a downward path for dispensing coins therefrom which coins enter and replenish the number of coins remaining in one or more depleted payout coin tubes. In order to operate the motor or solenoid of the additional coin tube or tubes so that coins can be dispensed therefrom one at a time to enter the corresponding tube in the payout mechanism, means are provided to monitor the exact change means or signal light which when activated indicates the lack of a particular coin or coins for payout. The additional pre-loaded supplemental coin tube or tubes, preferably will have a coin supply capacity larger than the tubes used for payout and the prescribed number of coins are fed from the supplemental coin tube or tubes, to the corresponding payout coin tube or tubes and this condition can be monitored and controlled by an already existing voltage that is applied to produce the exact change light signal commonly used on vending machines. In other words, no additional circuitry or voltage needs to be provided to cause a transfer of a coin from the supplemental coin tube to the corresponding payout coin tube.

With the supplemental coin tube pre-loaded, there is the possibility that the situation that produced the exact change condition may not change until another event takes place. This is so that a continued presence of the signal on this output will not cause an additional replenishment of coins prematurely. It is controlled by monitoring a voltage in the vending machine circuit which signifies that the additional event has taken place, i.e., that L6 transfers from one level to the other.

It is anticipated that some vending machines will produce a protocol signal instead of the exact change signal to indicate that a payout tube is depleted or about to be depleted. In such situations, the present invention provides means for the necessary interception and identification of this protocol signal between the changer and the vending machine controller.

The present invention also provides means for setting or adjusting a specific number of coins to be transferred upon the depletion indication from the vendor.

When the out-of-change indication does not indicate which denomination of coin has been depleted and where two or more supplemental coin denominations are available, the controlled release of one denomination can be used by monitoring the results of the out-of-change indication.

A different logic can be implemented by transferring coins from the supplemental coin tube or tubes in accordance with the acceptance and delivery of a product when the change required is already known. This can be accomplished by monitoring the delivery signal, the dollar output line and by knowing the sale price.

OBJECTS OF THE INVENTION

It is a principal object of the present invention to provide relatively simple and inexpensive means for increasing the change making capacity of a vending machine.

Other object is to provide means to upgrade the change making capability of a vending machine.

Another object is to increase the change making capacity of a vending machine by gravity feeding change making coins from a supplemental tube to a change making coin tube.

Another object is to increase the change making capacity of a vending machine without requiring changes in the structure or circuitry associated with the vending machine.

These and other objects and advantages of the present invention will become apparent after considering the following detailed specification in conjunction with the accompanying drawings.

BRIEF DESCRIPTION OF THE PREFERRED EMBODIMENT

Figure 1:
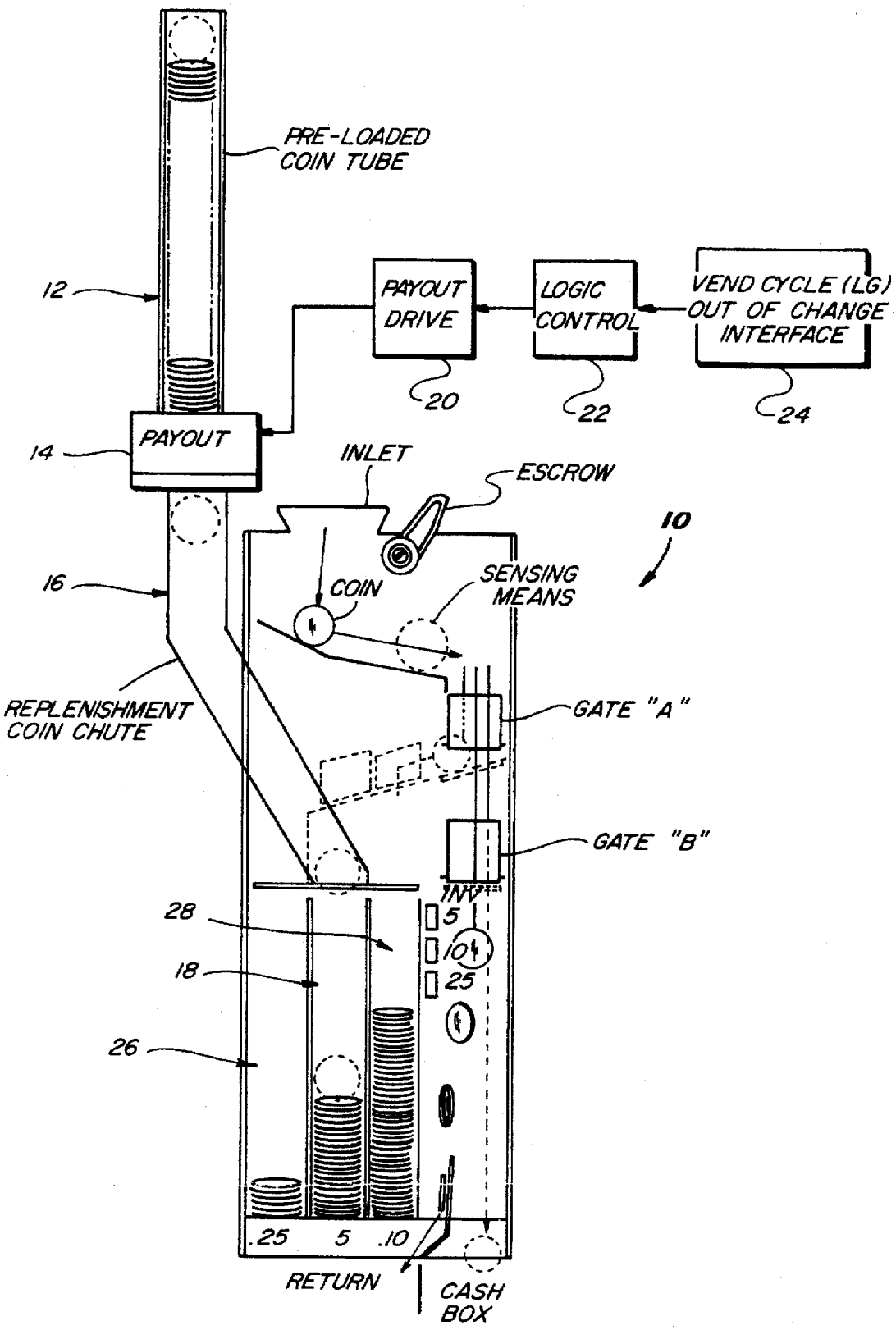
FIG. 1 is a side elevational view of the coin receiving portion of a vending machine, said view showing the addition of a supplemental coin tube from which coins are fed by gravity to one of the payout coin tubes in the device.

Referring to the drawings more particularly by reference numbers, number 10 refers to a coin unit which receives coins deposited in a vending machine and processes same, including making appropriate change when an over-deposit has been made. FIG. 1 also shows the addition of a supplemental coin tube 12 for use with the subject device. The supplemental coin tube 12 has a payout control feature 14 at the lower end thereof which payout control feature is connected by a tube 16 which receives coins paid out of the supplemental tube 12 and feeds them to a payout tube 18 located in the device 10. The pay out control means 14 may be in the form of a motor or solenoid which when energized enables the lowest coin in the supplemental tube 12 to be release from the supplemental coin tube 12 and to follow the tube 16 which delivers the coin to the coin tube 18 where similar coins accumulate. The payout control means 14 has a connection to circuit means which include a payout drive 20, a logic control 22 and an out-of-change interface circuit 24. It is common practice in the vending art to have an out-of-change interface circuit such as the circuit portion 24 which usually includes some sort of an indicator or light which when energized advises the customer that the machine is no longer able to provide change and therefore if the customer wants to buy a product from the vending machine he or she must deposit the exact change or run the risk of being short-changed. The same signal that causes the out-of-change condition to occur in the vending machine can now be used instead to feed a logic control circuit 22 and a payout drive circuit 20 to cause the payout means 14 to release a coin. If after release of a coin there is still a signal present on the out-of-change interface then a second, third and fourth coin may be released until there are enough coins in the coin tube 18 to satisfy the change making procedure. The supplemental coin tube 12 can have a length which accommodates a desired number of pre-loaded coins therein.

In the structure shown in FIG. 1, the vending device 10 has three different coin tubes including a quarter coin tube 26, a dime coin tube 28 and a nickel coin tube such as the nickel coin tube 18 identified above. If a nickel coin tube is to receive coins from the supplemental tube 12 then such coins will be fed, usually one at a time, and by gravity to the coin tube 18 until the desired number have been fed. As soon as the desired number of coins have been fed from the supplemental coin tube 12 to the coin tube 18 the out-of-change condition in the control circuit will have been satisfied and the light for the out-of-change condition will be turned off extinguished or not used at all.

The possibility exists that there will always be enough coins in the coin tubes 18, 26 and 28 so that it will never be necessary to feed coins from supplemental coin tube 12. However, if this is not the case then the possibility remains that more coins will be needed from the supplemental pre-loaded coin tube 12. If by some chance, the supplemental coin tube should, over time, feed all of the coins remaining therein to the coin tube 18, and then if the change tube is depleted the logic control circuit 22 will recognize this condition and energize the out-of-change signal so that the customer will know that he or she will not deposit money in the vending machine unless he or she realizes the risks that he or she is taking.

It is also possible to have two or more supplemental coin tubes for feeding to the same or to different ones of the change making coin tubes in the device 10. For example, a second and even a third supplemental coin tube could be provided, one handling dimes for feeding to the coin tube 28 and one for feeding quarters to the quarter coin tube 26. If this is done, each time a signal is present in the out-of-change circuit 24 a signal will be sent to the appropriate payout control device 14 and so on for feeding coins to the respective payback coin tubes.

One of the important advantages of the present device is the fact that the supplemental coin tube or tubes are mounted at a higher elevation than the payout coin tubes 18, 26 and 28 so that the coins in the supplemental coin tubes such as tube 12 will fall under the influence of the gravity into the appropriate payback coin tube.

Figure 2:
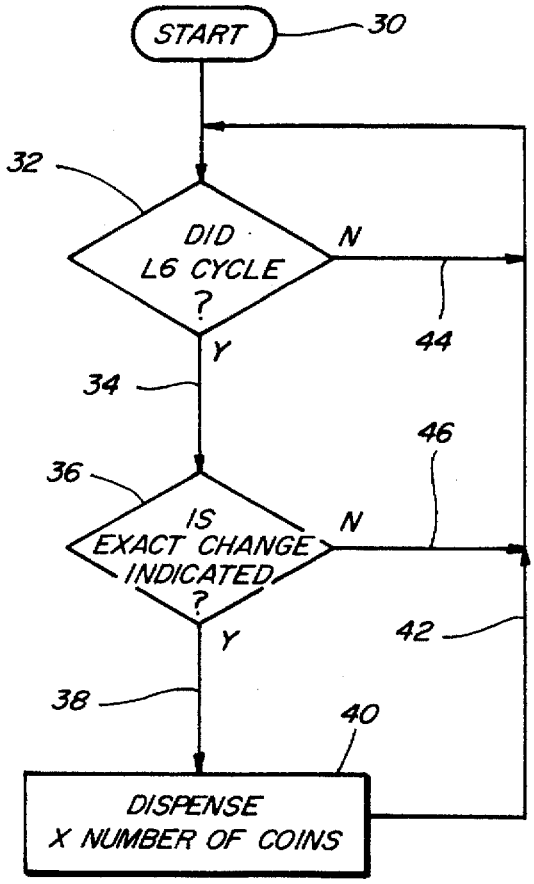
FIG. 2 is a flow chart for operation of the structure shown in FIG. 1.

FIG. 2 is a flow chart of the operation of the device described above. The flow chart has a start position 30 which feeds a signal to a block 32 which is labeled DID L6 CYCLE?. L6 refers to the signal that occurs during a vend delivery. If L6 did cycle then a signal will be produced on the output lead 34 which will be fed to another block 36 labeled IS EXACT CHANGE INDICATED. If this block has a yes output on lead 38 then this signal will be applied to block 40 labeled DISPENSE X NUMBER OF COINS. When X number of coins are dispensed then the output signal on lead 42 is fed back to the input of the block 32 to determine the next time that L6 cycles again and repeats the operation. If either of the blocks 32 or 36 has a No output condition at the time it receives its input then the No condition will be present on leads 44 or 46 for feeding back to the input of the block 32.

It can be seen that the means described for supplying additional coins to one or more of the payout coin tubes involves circuitry which is already present in the device and therefore installing the present device on an existing vending machine involves a minimal amount of change or modification to the already existing controls for the vending machine.

If over time the supplemental coin tube becomes empty or near empty, a signal could be generated at an appropriate place on the vending machine or at some other location so that the owner or proprietor of the vending machine can be made aware of this condition. It is then possible for the proprietor to insert more coins into the supplemental coin tube or tubes to extend the use of the vending machine in the normal manner. This can be done directly into the supplemental coin tube or by having a funnel located at the cite of the inlet end of the supplemental coin tube into which coins can be deposited for feeding into the supplemental coin tube and from there, when necessary, into the payback coin tubes using the mechanisms already described.

Figure 3:
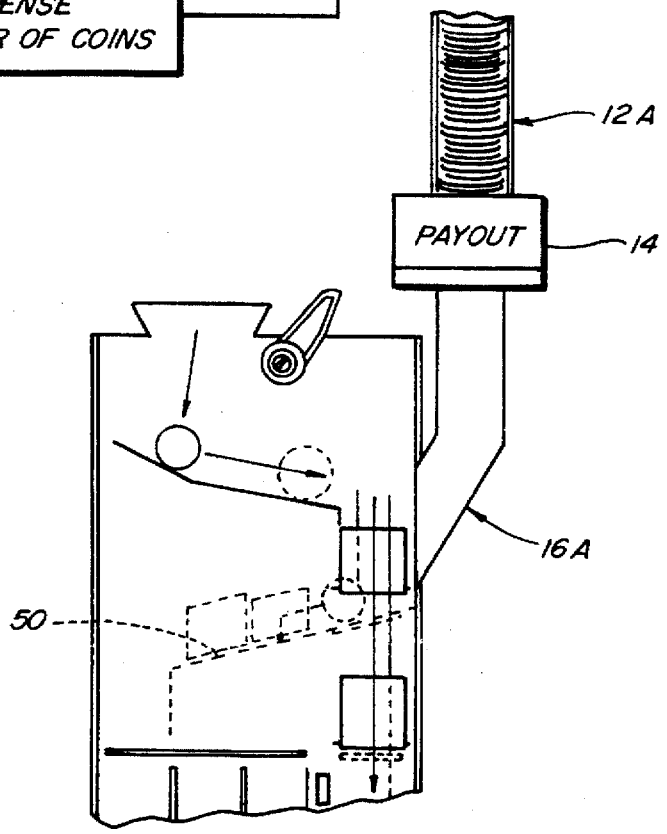
FIG. 3 is a fragmentary side elevational view similar to FIG. 1 but showing the coins for feeding to the payback tubes being fed to the same channel along which coins move that are deposited by the customer and FIG. 4 is a use similar to FIG. 3 but showing two pre-loaded coin tubes for feeding coins back to the payback coin tubes.
Figure 4:
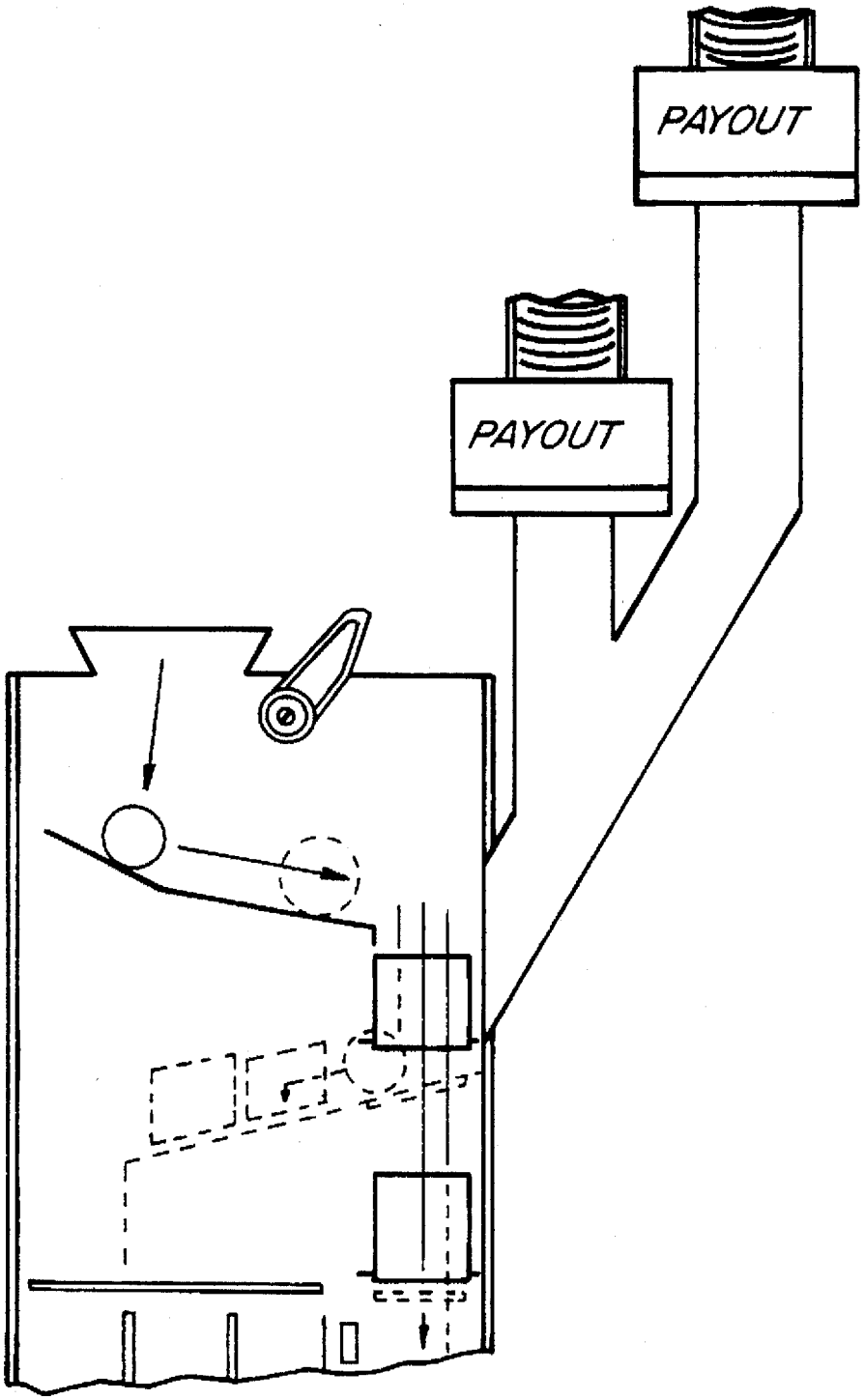

It is also possible to modify the construction disclosed in FIG. 1 by relocating the supplemental coin tube 12A so that coins feed therefrom can move along the same channel 50 that coins move along that are deposited by the customer. This is shown in FIG. 3. In this case, the supplemental coin tube 12A can have a large enough diameter to accommodate coins or more than one diameter and the coins as they leave the supplemental coin tube move along a coin chute 16A which orients the coins in a vertical orientation so that they can roll onto the channel 50 along which coins move that are deposited by the customer. If nickel and quarter coins are available in the supplemental coin tube, the nickels will fall into the nickel payback coin tube 18, the dimes will fall into the dime payback coin tube 28 and the quarters will fall into the quarter payback coin tube 26 in the same manner as coins deposited by the customer. It should be apparent however, that the supplemental coin tube 16A can be selected to accommodate one or more different coin denominations as required. The control circuit can be similar to that already described and the circuit can control a single coin tube with the same denomination coin or it can be modified to accommodate coins of different denominations from the same or different supplemental coin tubes as described. Thus the present invention greatly expands the payback capability of a vending machine and it does so without modifying or changing the circuitry or construction of the basic unit itself.

Thus there has been shown and described novel means for enabling a vending machine which has change making capabilities to continue to function for a much longer period of time due to the fact that the change making capability is constantly monitored and upgraded by feeding the necessary number of coins from a supplemental coin tube which is added to the present device without requiring much change at all. Many changes, modifications, variations and other uses and applications for the subject device are possible and all such changes, modifications, alterations and other uses and applications which do not depart from the spirit and scope of the invention are deemed to be covered by the invention which is limited only by the claims which follows.

What is claimed is:

1. In a vending machine control device having a plurality of tubes from which coins are dispensed to payback excess amounts of deposits, the improvement comprising a pre-loaded coin tube for the storage of coins of a denomination to be paid back as excess deposits, said preloaded coin tube having upper and lower ends both of which are at an elevation higher than the elevation of the upper end of the payback coin tubes for the same denomination coin, means located adjacent to the lower end of the pre-loaded coin tube energizable to release a coin from the lower end of the pre-loaded coin tube, conduit means having an inlet end for receiving coins released from the lower end of the pre-loaded coin tube, said conduit means including means for guiding released coins from the lower end of the pre-loaded coin tube portion into the payback tubes according to their denomination, means responsive to an out-of-change condition which occurs when the number of the coins in the payback coin tubes is less than some pre-determined quantity desired, said responsive means producing a response to energize the coin release means at the bottom of the pre-loaded coin tube to permit a coin from the pre-loaded coin tube to be guided by the conduit means into the corresponding denomination payback coin tube.

2. In the vending machine control device of claim 1 the payback coin tubes include a nickel payback coin tube and the pre-loaded coin tube is pre-loaded with nickels.

3. In the vending machine control device of claim 1 wherein the vending machine has at least two coin tubes from which coins are dispensed to payback excess amounts of deposit, the pre-loaded coin tube including two pre-loaded coin tubes for the storage of coins of the same respective denominations as the coins in the two payback coin tubes of the vending machine, each of said pre-loaded coin tubes having means for releasing coins from the bottom end thereof for feeding coins by way of the conduit means to respective ones of the payback coin tubes of the respective same denominations.

4. Means for increasing the payback capacity of a vending machine that receives coins deposited by a customer and pays back from payback coin tubes amounts equal to the excess amount of a deposit over the cost of the selected vend, the improvement comprising means for storing a supply of coins of the denomination used for payback in a vending machine at a location located higher than the payback coin tubes, means for releasing coins from the coin storage means, means for guiding released coins to move along a path into the upper end of the payback coin tubes, and means to control the release of coins from the coin storage means to maintain a condition in the payback coin tubes that is sufficient to meet the payback needs of the vending machine, said means for guiding released coins including conduit means having an inlet end for receiving coins released from the coin storage means and means for guiding released coins into corresponding denomination payback coin tubes.

5. The means of claim 4 wherein the means for storing a supply of coins includes a tube for accommodating coins of a denomination used for payback.

6. The means of claim 4 wherein the vending machine includes means for establishing a condition which normally indicates to the customer that there is no longer sufficient coins available in the payback tubes to make change, and means for using the establishment of this condition to release coins from the coin storage means for movement into the payback coin tubes.

7. The means of claim 4 for increasing the payback capacity of a vending machine comprising means for guiding released coins to move along a path into the upper end of the payback coin tubes, and means to signify that a vend has taken place.

8. The means of claim 4 wherein the vending machine includes means for establishing a condition to indicate that the customer should use the exact change if he wants to purchase an item, other means to indicate that a vend operation has taken place and means responsive to the simultaneously occurrence of these means to release coins from the coin storage means for movement into the payback coin tubes.

9. The means of claim 4 wherein the vending machine has means to indicate to a consumer that exact change should be deposited, and means responsive to said means for energizing the means for releasing at least one coin from the coin storage mean.

10. A coin handling mechanism for a vending machine including means for receiving deposits of coins, means including payback coin tubes for accumulating deposited coins according to their respective values for paying back amounts deposited in excess of a selected vend price, and means associated with one of said payback coin tubes for replenishing the supply of coins therein when the number falls below a pre-determined number, said last named means including a supplemental coin tube having upper and lower ends and a number of coins of the same denomination positioned therein, said supplemental coin tube having payout means at the lower end energizable to payout coins therefrom when energized, and a conduit communicating the lower end of the supplemental coin tube to the upper end of a payback coin tube of the same denomination coin, said conduit means feeding coins from the lower end of the supplemental coin tube into the portion of the vending device where coins deposited are separated into the payback tubes according to their denomination.

* * * * *